US012716586B2

(12) United States Patent
Naik et al.

(10) Patent No.: US 12,716,586 B2
(45) Date of Patent: Aug. 25, 2026

(54) TURBINE ENGINE HAVING A COMBUSTION SECTION WITH A FUEL NOZZLE HAVING A GASEOUS FUEL SUPPLY CHANNEL

(71) Applicant: GENERAL ELECTRIC COMPANY, Schenectady, NY (US)

(72) Inventors: Pradeep Naik, Bengaluru (IN); Michael T. Bucaro, Arvada, CO (US); Michael A. Benjamin, Loveland, OH (US); Sibtosh Pal, Mason, OH (US); Karthikeyan Sampath, Bengaluru (IN); Clayton Stuart Cooper, Loveland, OH (US); Steven C. Vise, Loveland, OH (US); Andrew Joseph Wickersham, Liberty Township, OH (US); Nicholas Ryan Overman, Sharonville, OH (US); Steven Marakovits, Mason, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/394,519

(22) Filed: Dec. 22, 2023

(65) Prior Publication Data

US 2025/0207775 A1 Jun. 26, 2025

(51) Int. Cl.

| | |
|---|---|
| ***F23R 3/00*** | (2006.01) |
| ***F23R 3/14*** | (2006.01) |
| *F23R 3/28* | (2006.01) |

(52) U.S. Cl.

CPC ..... *F23R 3/002* (2013.01); *F23R 3/14* (2013.01); *F23R 3/283* (2013.01); *F23R 3/286* (2013.01)

(58) Field of Classification Search

CPC ..... F23R 3/283; F23R 3/286; F23R 3/14

See application file for complete search history.

(56) References Cited

U.S. PATENT DOCUMENTS

| | | | | |
|---|---|---|---|---|
| 4,408,461 | A | 10/1983 | Bruhwiler et al. | |
| 4,815,664 | A * | 3/1989 | Tuthill | F23R 3/14 239/404 |
| 5,233,822 | A * | 8/1993 | Ward | F23R 3/60 60/39.37 |
| 5,303,542 | A | 4/1994 | Hoffa | |
| 5,351,477 | A * | 10/1994 | Joshi | F23D 17/002 60/737 |

(Continued)

FOREIGN PATENT DOCUMENTS

| | | | |
|---|---|---|---|
| CN | 113310071 | A | 8/2021 |
| EP | 1010945 | A2 | 6/2000 |

(Continued)

*Primary Examiner* — Thomas P Burke

(74) *Attorney, Agent, or Firm* — Carter, DeLuca & Farrell LLP

(57) ABSTRACT

A turbine engine has a compression section, a combustion section, and a turbine section in serial flow arrangement. The combustion section has a combustor liner and dome wall collectively forming at least a portion of a combustion chamber. The dome wall has a fuel nozzle opening. The combustion section has a fuel nozzle extending through the fuel nozzle opening. The fuel nozzle has a gaseous fuel supply channel, and a compressed air channel. The combustion section includes a gaseous fuel channel fluidly coupled to the gaseous fuel supply channel.

19 Claims, 8 Drawing Sheets

(56) References Cited

U.S. PATENT DOCUMENTS

| | | | | |
|---|---|---|---|---|
| 6,295,801 | B1 | 10/2001 | Burrus | |
| 6,367,262 | B1 | 4/2002 | Mongia et al. | |
| 6,530,222 | B2 | 3/2003 | Stuttaford et al. | |
| 7,017,329 | B2 | 3/2006 | Farhangi et al. | |
| 7,343,745 | B2 | 3/2008 | Inoue et al. | |
| 7,824,165 | B2 | 11/2010 | Davie et al. | |
| 8,205,452 | B2 | 6/2012 | Boardman et al. | |
| 8,266,911 | B2 | 9/2012 | Evulet | |
| 8,322,143 | B2 | 12/2012 | Uhm et al. | |
| 8,424,311 | B2 | 4/2013 | York et al. | |
| 9,062,883 | B2 | 6/2015 | Widener et al. | |
| 9,151,503 | B2 | 10/2015 | Melton et al. | |
| 9,243,803 | B2 | 1/2016 | Berry | |
| 9,353,950 | B2 | 5/2016 | Uhm et al. | |
| 9,951,956 | B2 | 4/2018 | Valeev | |
| 10,041,679 | B2 | 8/2018 | Prociw | |
| 10,865,989 | B2 | 12/2020 | Sadasivuni | |
| 11,054,137 | B2 | 7/2021 | Choi | |
| 11,085,643 | B2 | 8/2021 | Freeman et al. | |
| 11,248,528 | B2 | 2/2022 | Prociw | |
| 11,287,134 | B2 | 3/2022 | Berry | |
| 2002/0174657 | A1 | 11/2002 | Rice | |
| 2006/0042263 | A1* | 3/2006 | Patel | F23R 3/12 60/776 |
| 2007/0062202 | A1* | 3/2007 | Stastny | F23R 3/60 60/796 |
| 2010/0162716 | A1 | 7/2010 | Bastnagel et al. | |
| 2010/0275604 | A1 | 11/2010 | Hall | |
| 2010/0300102 | A1 | 12/2010 | Bathina et al. | |
| 2011/0162379 | A1 | 7/2011 | Baruah et al. | |
| 2011/0185703 | A1 | 8/2011 | Dodo et al. | |
| 2012/0151928 | A1 | 6/2012 | Patel et al. | |
| 2014/0109582 | A1 | 4/2014 | Shershnyov et al. | |
| 2016/0010864 | A1 | 1/2016 | Abe et al. | |
| 2016/0138807 | A1* | 5/2016 | Mongia | F23R 3/26 60/737 |
| 2016/0290646 | A1 | 10/2016 | Abe et al. | |
| 2016/0376997 | A1* | 12/2016 | Prociw | F23D 11/107 60/739 |
| 2017/0298817 | A1* | 10/2017 | Horiuchi | F02C 7/16 |
| 2019/0137103 | A1 | 5/2019 | Choi | |
| 2019/0203929 | A1* | 7/2019 | Benjamin | F23R 3/286 |
| 2019/0353350 | A1* | 11/2019 | Bellis | F23R 3/14 |
| 2023/0055939 | A1* | 2/2023 | Binek | F23R 3/283 |
| 2023/0204213 | A1 | 6/2023 | Naik et al. | |
| 2023/0213191 | A1* | 7/2023 | Vukanti | F23R 3/50 60/752 |
| 2023/0250958 | A1 | 8/2023 | Jeong et al. | |
| 2024/0328360 | A1 | 10/2024 | Bucaro | |

FOREIGN PATENT DOCUMENTS

| | | | |
|---|---|---|---|
| EP | 3109557 | A2 | 12/2016 |
| EP | 3809044 | A1 | 4/2021 |
| EP | 3845812 | A1 | 7/2021 |
| EP | 4212775 | A1 | 7/2023 |
| KR | 1020230120334 | A1 | 8/2023 |
| WO | 2013/065624 | A1 | 5/2013 |

* cited by examiner

TURBINE ENGINE HAVING A COMBUSTION SECTION WITH A FUEL NOZZLE HAVING A GASEOUS FUEL SUPPLY CHANNEL

TECHNICAL FIELD

The present subject matter relates generally to a turbine engine, and more specifically to a turbine engine having a combustion section including a fuel nozzle.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called NOx), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
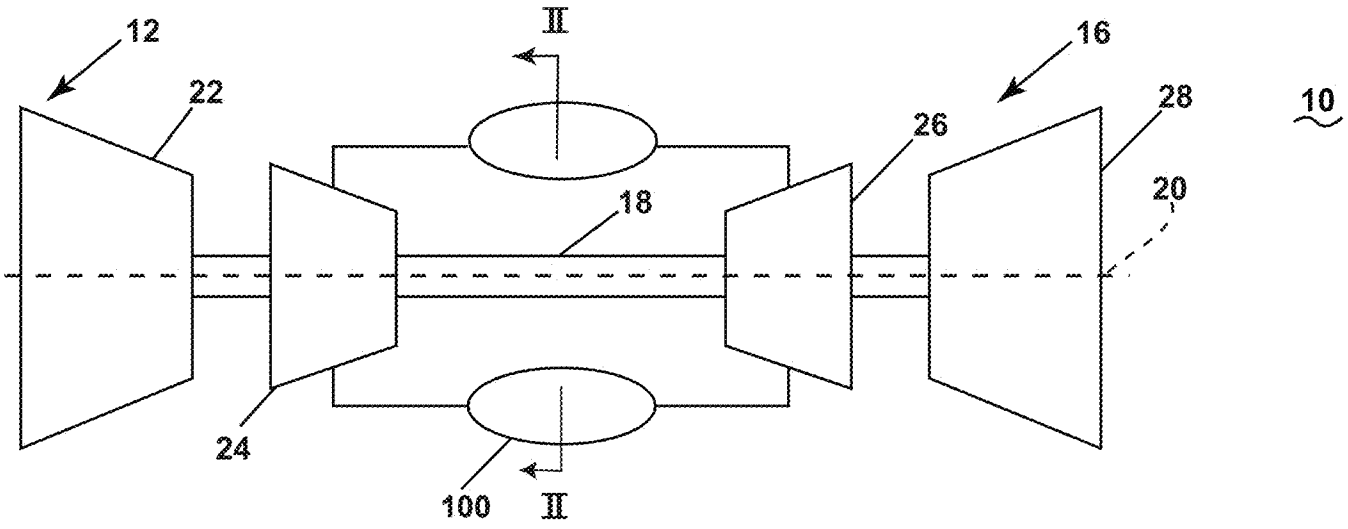
FIG. 1 is a schematic representation of a turbine engine, the turbine engine including a compression section, a combustion section, and a turbine section.

Aspects of the disclosure described herein are directed to a turbine engine including a combustion section including a casing, a fuel nozzle, a dome wall, a combustor liner and a gaseous fuel supply. The gaseous fuel supply and the fuel nozzle are integrally formed to define a unitary body. As used herein, the term "unitary body" or iteration thereof refers to a combination of parts that are integrally formed. A combination of parts forming a unitary body does not include physical couplings, such as welding, adhesion, or fastening between the combination of parts. The casing includes a fuel port. The gaseous fuel supply extends through the fuel port.

The fuel nozzle is especially well adapted for the use of hydrogen fuel (hereinafter, "H2 fuel"). Specifically, the fuel nozzle is especially well adapted to feed a flow of gaseous H2 fuel to the combustion chamber. H2 fuels, when compared to traditional fuels (e.g., carbon fuels, petroleum fuels, etc.), have a higher burn temperature and velocity. Further, flashback can occur when using H2 fuels. As used herein, flashback refers to unintended flame propagation when the H2 fuel is combusted. H2 fuel has higher volatility, meaning that once the H2 fuel is combusted or ignited, the flame generated by the ignition of the H2 fuel can expand in undesired location; in other words, flashback can occur. For example, the flame can expand into the fuel nozzle or igniter. The fuel nozzle, as described herein, ensures flashback of the H2 fuel does not occur. Auto-ignition of the H2 fuel can occur if the H2 fuel is too hot. Auto-ignition of the H2 fuel can be undesirable in certain locations of the combustion section. The fuel nozzle as described herein ensures that the temperature of the H2 fuel is below the auto-ignition temperature until at least when it is desired to ignite the H2 fuel.

As used herein, the term "gaseous fuel" or iterations thereof refers to a combustible fuel in a gaseous state. It will be appreciated that gaseous fuel is different from atomized fuel. Atomized fuel utilizes an impeller, orifices, or the like to take a liquid fuel and atomize the liquid fuel into very small droplets.

In some aspects, the gaseous fuel exits the fuel nozzle with a given speed and then mixes with air for combustion. As the fuel/air mixture burns, the flame propagates upstream. It can be desirable to control or maintain a constant flame in the combustor for ignition of subsequent fuel, and not to continually ignite the fuel with an ignitor.

For purposes of illustration, the present disclosure will be described with respect to a turbine engine (gas turbine engine). It will be understood, however, that aspects of the disclosure described herein are not so limited and that a fuel nozzle as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

FIG. 1 is a schematic view of a turbine engine 10. As a non-limiting example, the turbine engine 10 can be used within an aircraft. The turbine engine 10 can include, at least, a compression section 12, a combustion section 100, and a turbine section 16 in serial flow arrangement. A drive shaft 18 rotationally couples the compression section 12 and the turbine section 16, such that rotation of one affects the rotation of the other, and defines a rotational axis or engine centerline 20 for the turbine engine 10.

The compression section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compression section 12 can include a plurality of axially spaced stages. Each stage includes a set of circumferentially-spaced rotating blades and a set of circumferentially-spaced stationary vanes. The compressor blades for a stage of the compression section 12 can be mounted to a disk, which is mounted to the drive shaft 18. Each set of blades for a given stage can have its own disk. The vanes of the compression section 12 can be mounted to a casing which can extend circumferentially about the turbine engine 10. It will be appreciated that the representation of the compression section 12 is merely schematic and that there can be any number of stages. Further, it is contemplated, that there can be any other number of components within the compression section 12.

Similar to the compression section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 100 can be provided serially between the compression section 12 and the turbine section 16. The combustion section 100 can be fluidly coupled to at least a portion of the compression section 12 and the turbine section 16 such that the combustion section 100 at least partially fluidly couples the compression section 12 to the turbine section 16. As a non-limiting example, the combustion section 100 can be fluidly coupled to the HP compressor 24 at an upstream end of the combustion section 100 and to the HP turbine 28 at a downstream end of the combustion section 100.

During operation of the turbine engine 10, ambient or atmospheric air is drawn into the compression section 12 via a fan (not illustrated) upstream of the compression section 12, where the air is compressed defining a compressed air. The compressed air can then flow into the combustion section 100 where the compressed air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The compressed airflow and the combustion gases can together define a working airflow that flows through the fan, compression section 12, combustion section 100, and turbine section 16 of the turbine engine 10.

Figure 2:
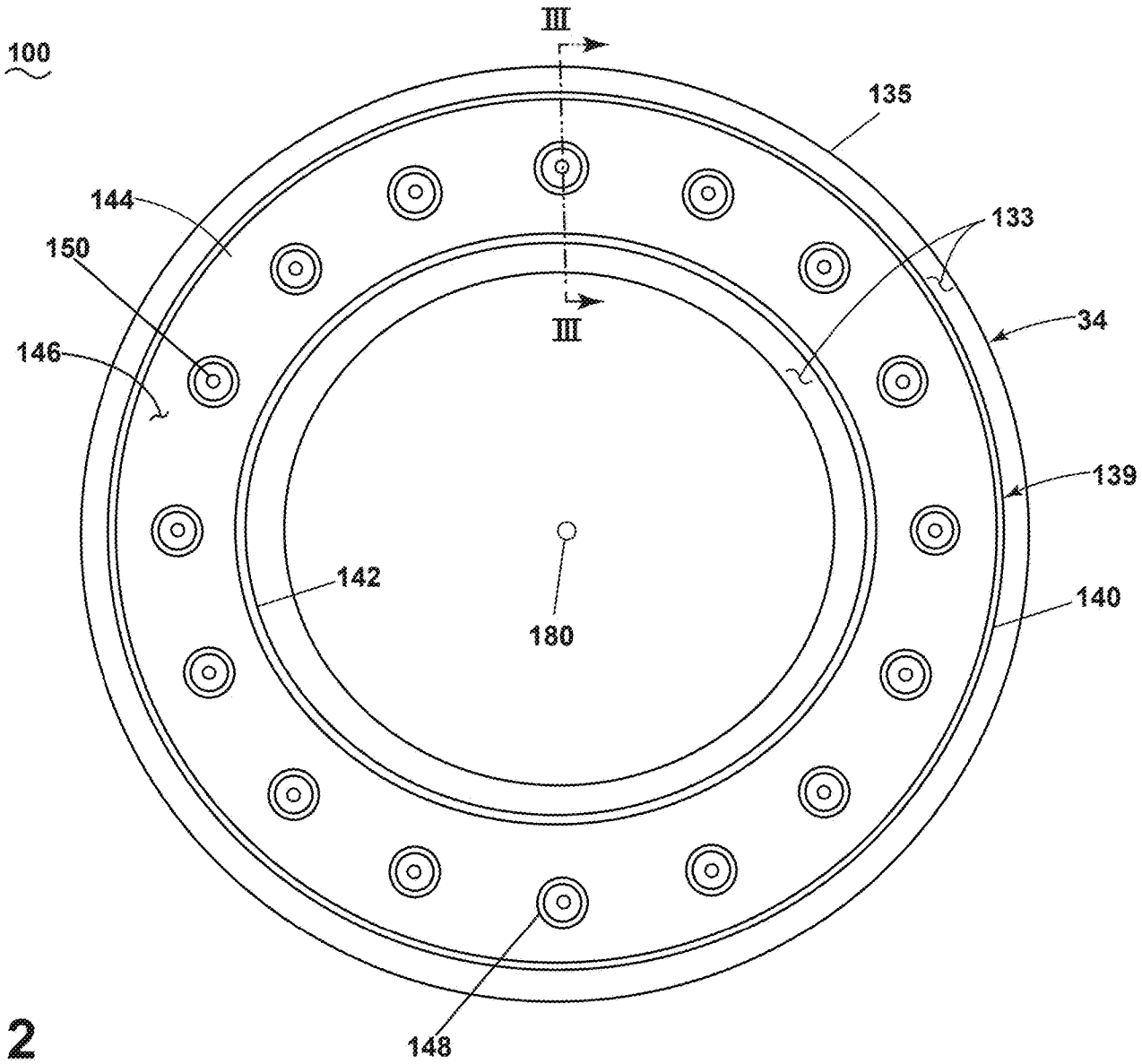
FIG. 2 depicts a cross-section view of the combustion section taken along line II-II of FIG. 1, further illustrating a set of fuel nozzles.

FIG. 2 depicts a cross-sectional view of the combustion section 100 along line II-II of FIG. 1. For purposes of illustration, the drive shaft 18 (FIG. 1) has been removed. The combustion section 100 includes a combustor 34. The combustor 34 includes a dome wall 144 including a set of fuel nozzle openings (not illustrated). The combustor 34 includes a set of fuel nozzles 148 provided within the set of fuel nozzles openings. The set of fuel nozzles 148 are annularly arranged about a combustor centerline 180. The combustor centerline 180 can be the engine centerline 20 (FIG. 1) of the turbine engine 10 (FIG. 1). Additionally, or alternatively, the combustor centerline 180 can be a centerline for the combustion section 100, a single combustor, or a set of combustors that are arranged about the combustor centerline 180.

The set of fuel nozzles 148 are arranged about the combustor centerline 180. Each fuel nozzle of the set of fuel nozzles 148 includes a respective centerline axis 150. The set of fuel nozzles 148 can include rich cups, lean cups, or a combination of both rich and lean cups annularly provided about the engine centerline. The combustor 34 is defined by a combustor liner 139. The combustor 34 can have a can, can-annular, or annular arrangement depending on the type of engine in which the combustor 34 is located. In a non-limiting example, the combustor 34 can have a combination arrangement as further described herein located within a casing 135 of the engine. The combustor liner 139, as illustrated by way of example, can be annular. The combustor liner 139 can include an outer combustor liner 140 and an inner combustor liner 142 concentric with respect to each other and annular about the engine centerline 20. The dome wall 144 extends between the outer combustor liner 140 and the inner combustor liner 142. The combustor liner 139 further defines the set of fuel nozzles 148. The dome wall 144 together with the combustor liner 139 can define a combustion chamber 146 annular about the engine centerline 20. The set of fuel nozzles 148 can be fluidly coupled to the combustion chamber 146. A compressed air passageway 133 can be defined at least in part by both the combustor liner 139 and the casing 135. Each fuel nozzle of the set of fuel nozzles 148 is defined by a discrete body extending through a respective portion of the dome wall 144 and being configured to exhaust a flow of gaseous fuel and compressed air into the combustion chamber 146.

Figure 3:
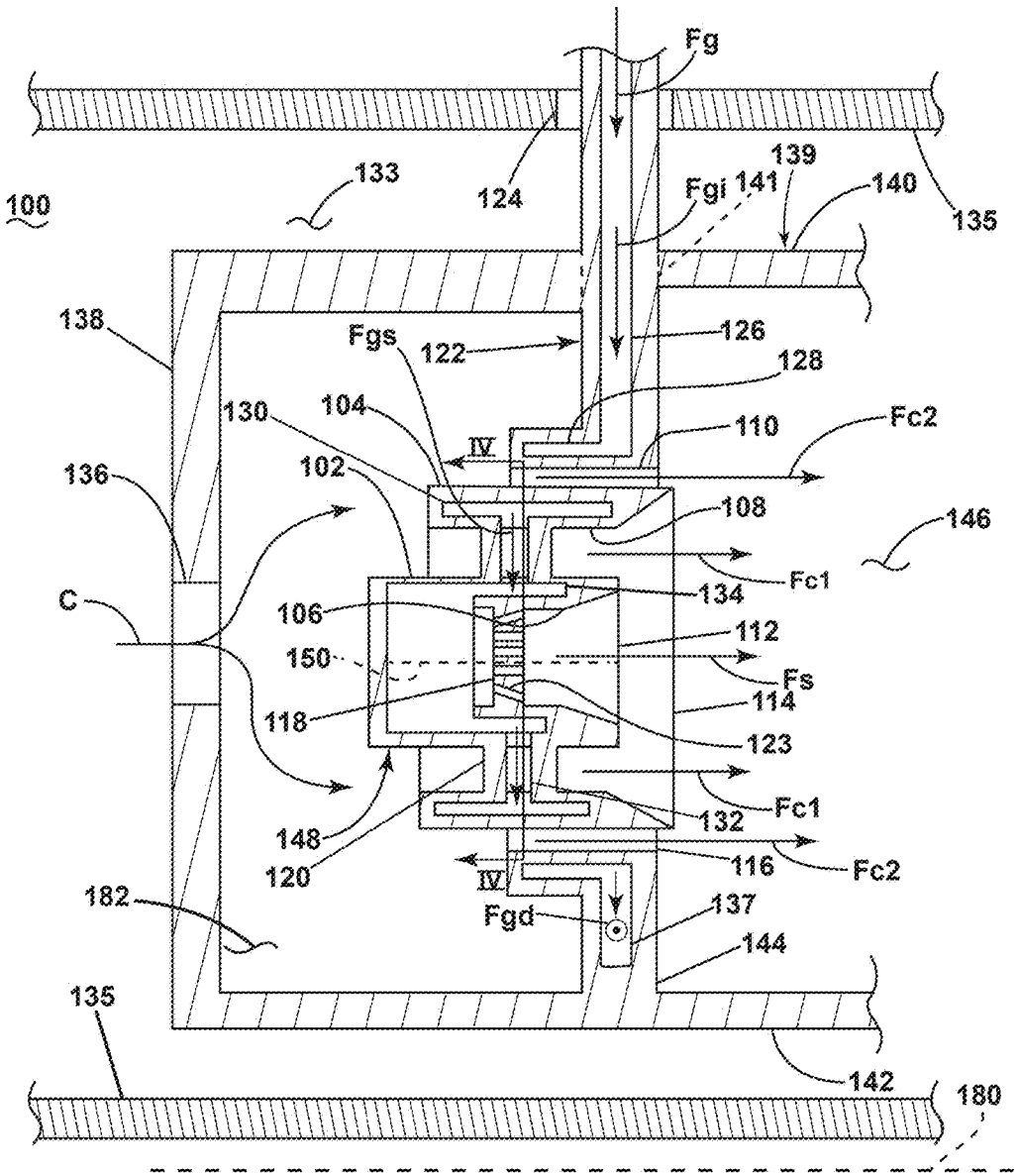
FIG. 3 is a schematic of a side cross-sectional view taken along line III-III of FIG. 2, further illustrating a fuel nozzle of the set of fuel nozzles, a casing, a dome wall, a combustor liner, a fuel port and a gaseous fuel supply, the gaseous fuel supply having a first circumferential gaseous fuel manifold.

FIG. 3 is a schematic side cross-sectional view of the combustion section 100 as seen from sectional line III-III of FIG. 2. The combustion section 100 includes a cowl 138. The cowl 138, the outer combustor liner 140, and the inner combustor liner 142 collectively form the combustor liner 139. The cowl 138 is provided axially forward of, with respect to the combustor centerline 180, the outer combustor liner 140 and the inner combustor liner 142. A compressed air opening 136 is provided within the cowl 138. The cowl 138 can include any number of one or more compressed air openings 136. The compressed air opening 136 can be formed as a channel extending circumferentially about the combustor centerline 180, a series of holes circumferentially spaced about the combustor centerline 180, or a combination thereof.

A set of flame shaping holes 110 are formed between the dome wall 144 and the fuel nozzle 148. The set of flame shaping holes 110 exhaust into the combustion chamber 146 at a flame shaping outlet 116. The set of flame shaping holes 110 can be formed as a non-continuous or continuous channel or hole that extends continuously about an entirety of or less than the entirety of the centerline axis 150. The set of flame shaping channels 110 can be formed as a set of circumferentially spaced segments.

A cavity 182 is defined between the cowl 138 and the dome wall 144. The cavity 182 is provided on an opposing side of the dome wall 144 from the combustion chamber 146. The fuel nozzle 148 extends into the cavity 182. The fuel nozzle 148 terminates within the cavity 182. The fuel nozzle 148 does not extend through any portion of the cowl 138, the outer combustor liner 140 and the inner combustor liner 142.

The fuel nozzle 148 includes a first body 102 and a second body 104. The first body 102 defines a gaseous fuel channel 106. The gaseous fuel channel 106 exhausts into a respective portion of the combustion section 100 aseous fuel outlet 112. The second body 104 defines a compressed air channel 108 exhausting into the combustion chamber 146 at a compressed air outlet 114. The second body 104 is provided radially outward from the first body 102, with respect to the centerline axis 150. The second body 104 circumscribes the first body 102. The dome wall 144 is provided radially outward from, with respect to the centerline axis 150, the second body 104.

The fuel nozzle 148 can include a gaseous fuel swirler 118 and an air swirler 120. The gaseous fuel swirler 118 is provided within the gaseous fuel channel 106. The air swirler 120 is provided within the compressed air channel 108. The air swirler 120 extends between the first body 102 and the second body 104. The gaseous fuel swirler 118 and the air swirler 120 are integrally formed to or coupled to the first body 102. The air swirler 120 is integrally formed with or coupled to the second body 104. The air swirler 120 defines a connection between the first body 102 and the second body 104. As a non-limiting example, the first body 102, the gaseous fuel swirler 118, the air swirler 120, and the second body 104 can be integrally formed such that the first body 102, the gaseous fuel swirler 118, the air swirler 120 and the second body 104 form a unitary body. In other words, the fuel nozzle 148 can be formed as a unitary body.

The gaseous fuel swirler 118 and the air swirler 120 are any suitable components configured to swirl a flow of fluid from an upstream edge of the respective swirler to a downstream edge of the respective swirler. As a non-limiting example, the gaseous fuel swirler 118, the air swirler 120, or a combination thereof can be an airfoil or a plurality of airfoils provided within the gaseous fuel channel 106 or the compressed air channel 108, respectively. As a non-limiting example, the gaseous fuel swirler 118 can be an orifice plate including a plurality of orifices 123. The plurality of orifices 123 are oriented to provide the swirling effect of a swirler. It will be appreciated that either or both of the gaseous fuel swirler 118 or the air swirler 120 can be formed as an orifice plate or the plurality of airfoils.

The amount of swirl to the flow of fluid that flows over or through the gaseous fuel swirler 118 and the air swirler 120 is quantified by a swirl number defined as an integral of the tangential momentum to the axial momentum of the flow of fluid downstream of a respective swirler. The gaseous fuel swirler 118 and the air swirler 120 are defined as swirlers that create a swirled airflow having swirl number of greater than or equal to 0.2 and less than or equal to 1.2.

An opening defining a fuel port 124 is formed within a portion of the casing 135. The fuel port 124 is provided along any suitable portion of the casing 135. As a non-limiting example, the fuel port 124 is axially aligned, with respect to the combustor centerline 180, with where the dome wall 144 meets the outer combustor liner 140. A gaseous fuel supply channel 122 extends through the fuel port 124 and into the compressed air passageway 133. The gaseous fuel supply channel 122 extends through a respective portion of the combustor liner 139, the dome wall 144, or a combination thereof, and ultimately to the gaseous fuel channel 106. The fuel port 124 can be sized to leave a space between the gaseous fuel supply channel 122 and the casing 135. Alternatively, the fuel port 124 can be sized such that the gaseous fuel supply channel 122 contacts a respective portion of the casing 135.

The gaseous fuel supply channel 122 includes a dome wall inlet segment 126, a first circumferential gaseous fuel manifold 128, a second circumferential gaseous fuel manifold 130, a swirler segment 132, a third circumferential gaseous fuel manifold 134, and a dome wall distribution segment 137. It will be appreciated that at least a portion of the gaseous fuel supply channel 122 (e.g., the dome wall inlet segment 126) is formed with the dome wall 144. As used herein, the term "formed with the dome wall" refers to a portion of the gaseous fuel supply channel 122 that directly contacts or is formed within (e.g., integrally formed with) the dome wall 144.

The dome wall inlet segment 126 extends through a respective portion of the dome wall 144. The dome wall inlet segment 126 is fluidly coupled to the first circumferential gaseous fuel manifold 128 formed within the dome wall 144. The second circumferential gaseous fuel manifold 130 is formed within the second body 104. The first circumferential gaseous fuel manifold 128 is fluidly coupled to the second circumferential gaseous fuel manifold 130. The third circumferential gaseous fuel manifold 134 is formed within the first body 102 and is directly fluidly coupled to the gaseous fuel channel 106. The third circumferential gaseous fuel manifold 134 is fluidly coupled to the second circumferential gaseous fuel manifold 130 through the swirler segment 132. The swirler segment 132 extends through an interior of the air swirler 120.

The gaseous fuel supply channel 122 extends between any suitable number of one or more fuel nozzles of the set of fuel nozzles 148. As a non-limiting example, the combustion section 100 can include a single, continuous gaseous fuel supply channel 122 that feeds gaseous fuel to each fuel nozzle of the set of fuel nozzles 148. Alternatively, the combustion section 100 can include two or more separate fuel channels that feed gaseous fuel to a respective subset of fuel nozzles of the set of fuel nozzles 148.

Each fuel nozzle of the set of fuel nozzles 148 can include a respective first circumferential gaseous fuel manifold 128, second circumferential gaseous fuel manifold 130, and third circumferential gaseous fuel manifold 134 that feed gaseous fuel to the respective gaseous fuel channel 106 of the respective fuel nozzle 148. In instances where two or more fuel nozzles 148 are fluidly coupled to a single gaseous fuel supply channel 122, the dome wall distribution segment 137 interconnects the first circumferential gaseous fuel manifold 128 of circumferentially adjacent fuel nozzles 148. The dome wall distribution segment 137 can extend radially, circumferentially, or a combination thereof through the dome wall 144 between adjacent fuel nozzles 148. The dome wall distribution segment 137 can extend from any suitable portion of the first circumferential gaseous fuel manifold 128.

The fuel nozzle 148 and the gaseous fuel supply channel 122 can be integrally formed with the dome wall 144, the combustor liner 139, or a combination thereof to define a respective unitary body. As a non-limiting example, the fuel nozzle 148, the gaseous fuel supply channel 122 and the dome wall 144 can be integrally formed to form a unitary body. The unitary body of the fuel nozzle 148, the gaseous fuel supply channel 122 and the dome wall 144 can subsequently be coupled to the combustor liner 139, and the cowl 138 at, for example, coupling junctions 141 illustrated in phantom lines. The unitary body of the fuel nozzle 148, the gaseous fuel supply channel 122 and the dome wall 144 can be coupled to the combustor liner 139 through any suitable coupling method such as, but not limited to, adhesion, welding, fastening, or the like.

During operation, a flow of gaseous fuel (Fg) is fed to the gaseous fuel supply channel 122 through the fuel port 124. The flow of gaseous fuel (Fg) flows through the dome wall inlet segment 126 to define an inlet flow of gaseous fuel (Fgi). The inlet flow of gaseous fuel (Fgi) is fed to to the first circumferential gaseous fuel manifold 128. The inlet flow of gaseous fuel (Fgi) within the first circumferential gaseous fuel manifold 128 is fed to at least one of either the second circumferential gaseous fuel manifold 130, or the dome wall distribution segment 137. When fed to the dome wall distribution segment 137, the inlet flow of gaseous fuel (Fgi) can be fed to other portions of the gaseous fuel supply channel 122 (e.g., to adjacent fuel nozzles 148) to define a distribution flow of gaseous fuel (Fgd). The flow of gaseous fuel (Fg) can contain 100% hydrogen ("H2") fuel or a mixture of hydrogen fuel and another gaseous fuel (e.g., methane). Alternatively, the flow of gaseous fuel (Fg) can be a mixture of H2 fuel and compressed air from, for example, from the compression section (e.g., the compression section 12 of FIG. 1).

At least a portion of the inlet flow of gaseous fuel (Fgi) within the first circumferential gaseous fuel manifold 128 is fed to the second circumferential gaseous fuel manifold 130. At least a portion of the fuel within the second circumferential gaseous fuel manifold 130 is fed to the third circumferential gaseous fuel manifold 134 through the swirler segment 132 as a flow of supply gaseous fuel (Fgs). At least a portion of the flow of supply gaseous fuel (Fgs) is fed to the gaseous fuel channel 106 where it is swirled by the gaseous fuel swirler 118 to define a swirled flow of gaseous fuel (Fs). The swirled flow gaseous fuel (Fs) is fed to the combustion chamber 146. The swirled flow of gaseous fuel (Fs) is ignited, via an ignitor, downstream of the gaseous fuel swirler 118. The ignition of the swirled flow of gaseous fuel (Fs) creates a flame within the combustion chamber 146.

A flow of compressed air (C) is fed to the fuel nozzle 148 from the compressed air passageway 133 and through the compressed air opening 136. The flow of compressed air (C) is drawn from a compressed air supply such as the LP compressor 22 or the HP compressor 24 of FIG. 1. The flow of compressed air (C) is fed to the compressed air channel 108 and the set of flame shaping holes 110 to define a first flow of compressed air (Fc1) and a second flow of compressed air (Fc2), respectively. The first flow of compressed air (Fc1) and the second flow of compressed air (Fc2) are fed to the combustion chamber 146.

The first flow of compressed air (Fc1) and the second flow of compressed air (Fc2) are used to shape the flame (e.g., provide a desired footprint of the physical flame within the combustion chamber 146), and insulate various portions of the combustion section 100 from the flame generated by the ignition of the swirled flow of gaseous fuel (Fs). The flame shaping is done by forming an annular curtain of compressed air around the flame. The annular curtain of compressed air, in turn, directs the flame or otherwise the swirled flow of gaseous fuel (Fs) in a desired direction and keeps the flame within desired boundaries at least partially defined by the annular curtain of compressed air. The annular curtain of compressed air further insulates various portions of the combustion section 100 (e.g., the dome wall 144, the combustor liner 139, etc.) from the heat of the flame by providing layers of insulation between the flame and other sections of the combustion section 100 or otherwise cooling the other sections of the combustion section 100.

The shaping and insulation of the flame is especially important when utilizing a gaseous H2 fuel in comparison with traditional fuels. The gaseous H2 fuel burns at a higher temperature and has a higher tendency for flashback compared to the traditional fuels. The first flow of compressed air (Fc1) and the second flow of compressed air (Fc2) are used to accommodate for the higher burn temperatures and higher tendency for flashback. The pushing of the swirled flow of gaseous fuel (Fs) away from the fuel nozzle 148 helps ensure that flashback into the fuel nozzle 148 of the swirled flow of fuel (Fs), once ignited, does not occur. The first flow of compressed air (Fc1) and the second flow of compressed air (Fc2) further ensures that the flame, which burns hotter than a flame generated from the traditional fuels, does not overly heat sections of the combustion section 100. The first flow of compressed air (Fc1) and the second flow of compressed air (Fc2) can further be used to create a uniform flame distribution at the combustor outlet. It is contemplated that a uniform flame distribution or temperature distribution at the combustor outlet results in a higher efficiency of the turbine section 16 (FIG. 1).

The flow of gaseous fuel (Fg) through the gaseous fuel supply channel 122, specifically the inlet flow of gaseous fuel (Fgi), is further used to cool the dome wall 144. Cooling the dome wall 144 through use of the flow of gaseous fuel (Fg) increases the lifespan of the dome wall 144 by decreasing the thermal stresses the dome wall 144 is subjected to during operation of the combustion section 100. It will be appreciated that the dome wall 144 is sized to insulate the flow of gaseous fuel (Fg) from the flame enough to ensure that the flow of gaseous fuel (Fg) does not exceed a threshold temperature and undergo auto-ignition.

While not illustrated, the combustion section 100 can include a controller module communicatively coupled to a set of valves in order to automatically control a flow of fluids to or within respective portions of the combustion section 100. As a non-limiting example, the controller module can automatically control a supply of the flow of gaseous fuel (Fg) to and through the gaseous fuel supply channel 122. As a non-limiting example, the controller module can automatically control a supply of the flow of compressed air (C) to the compressed air channel 108, the set of flame shaping holes 110, or a combination thereof to define the first flow of compressed air (Fc1) and the second flow of compressed air (Fc2), respectively. The flow of fluids to or within respective portions of the combustion section 100 can be done independently of one another. As a non-limiting example, the supply of the flow of compressed air (C) to the compressed air channel 108 can be done independently to the supply the supply of the flow of compressed air (C) to the set of flame shaping holes 110.

Figure 4:
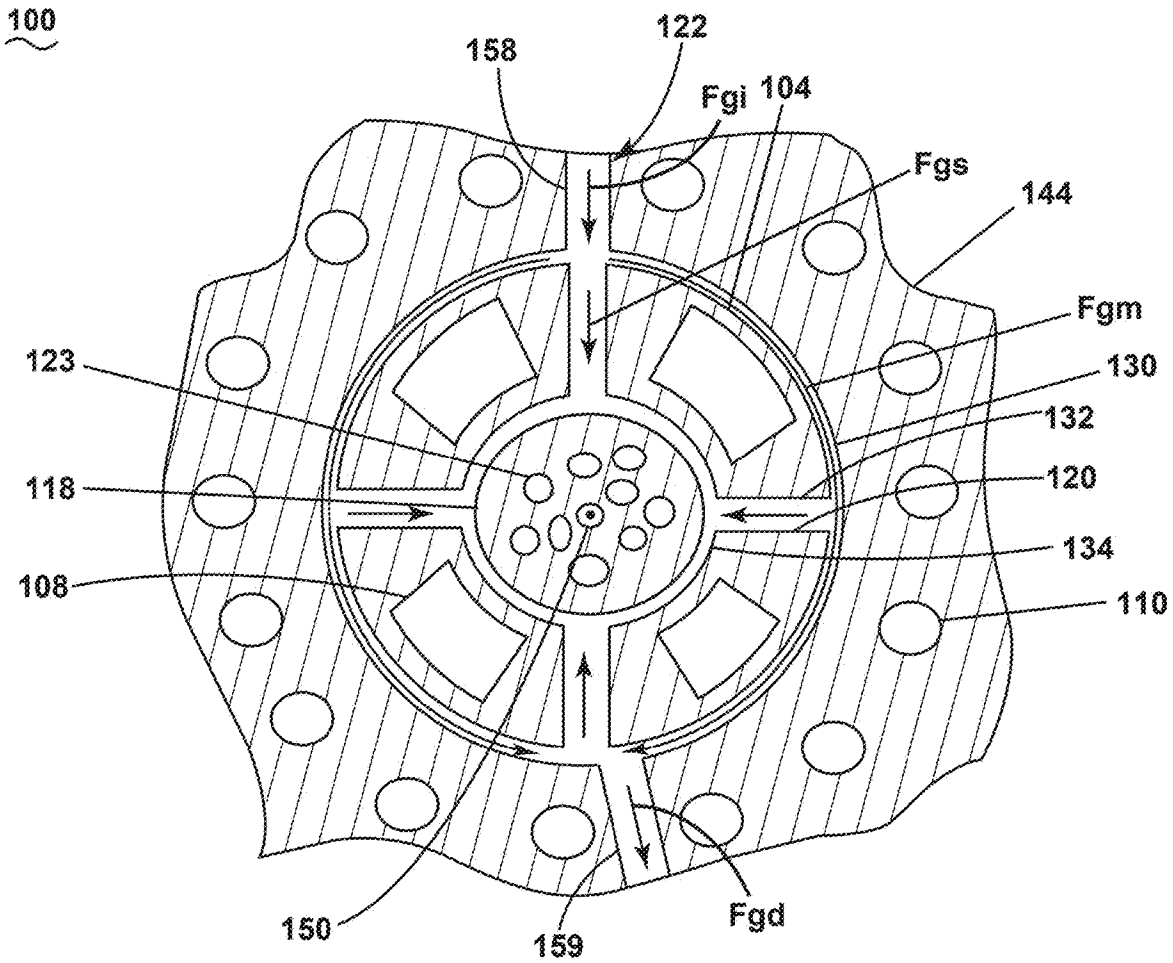
FIG. 4 is a schematic cross-sectional view of a section of the combustion section taken along line IV-IV of FIG. 3, further illustrating a second circumferential gaseous fuel manifold and a third circumferential gaseous fuel manifold of the gaseous fuel supply.

FIG. 4 is a schematic cross-sectional view of a section of the combustion section 100 taken along line IV-IV of FIG. 3. The first circumferential gaseous fuel manifold 128 (FIG. 3), second circumferential gaseous fuel manifold 130 and the third circumferential gaseous fuel manifold 134 can each be formed as annular channels that extend continuously or non-continuously about an entirety of or less than an entirety of a circumferential extent of the centerline axis 150. The first circumferential gaseous fuel manifold 128 circumscribes the second circumferential gaseous fuel manifold 130, which circumscribes the third circumferential gaseous fuel manifold 134, which circumscribes the gaseous fuel channel 106. As a non-limiting example, at least one of the first circumferential gaseous fuel manifold 128, the second circumferential gaseous fuel manifold 130, the third circumferential gaseous fuel manifold 134, or a combination thereof can be defined by circumferentially discrete segments. The set of flame shaping holes 110 can include a plurality of flame shaping holes circumferentially spaced about the centerline axis 150. Alternatively, the flame shaping channel 110 can be defined by one or more channels extending continuously or non-continuously about an entirety of less than the entirety of a circumferential extent of the centerline axis 150.

The gaseous fuel supply channel 122 includes a set of connecting channels fluidly coupling respective portions of the first circumferential gaseous fuel manifold 128 (FIG. 3) to the second circumferential gaseous fuel manifold 130. There can be any number of one or more connecting channels. As a non-limiting example, the set of connecting channels can include an inlet connecting channel 158 and an outlet connecting channel 159. The inlet connecting channel 158 is defined as a channel of the gaseous fuel supply channel 122 that feeds a flow of gaseous fuel directly to the second circumferential gaseous fuel manifold 130. The outlet connecting channel 159 is defined as a channel of the gaseous fuel supply channel 122 that is fed a flow of gaseous fuel directly from the second circumferential gaseous fuel manifold 130.

At least one air swirler 120 includes the swirler segment 132. It will be appreciated that any number of one or more air swirlers 120 can include the swirler segment 132. As a non-limiting example, each air swirler 120 can include the swirler segment 132.

During operation, the inlet flow of gaseous fuel (Fgi) is fed through the inlet connecting channel 158 from the first circumferential gaseous fuel manifold 128 (FIG. 3). At least a portion of the inlet flow of gaseous fuel (Fgi) is fed to the second circumferential gaseous fuel manifold 130 to define a manifold flow of gaseous fuel (Fgm). The manifold flow of gaseous fuel (Fgm) is fed circumferentially through at least a portion of the second circumferential gaseous fuel manifold 130. At least a portion of the manifold flow of gaseous fuel (Fgm) is fed to the third circumferential gaseous fuel manifold 134 through the swirler segment 132 as the flow of supply gaseous fuel (Fgs). At least a portion of the manifold flow of gaseous fuel (Fgm) is fed back to a portion of the first gaseous fuel manifold 128, or directly to the dome wall distribution segment 137 (FIG. 3), through the outlet connecting channel 159 as the distribution flow of gaseous fuel (Fgd).

Figure 5:
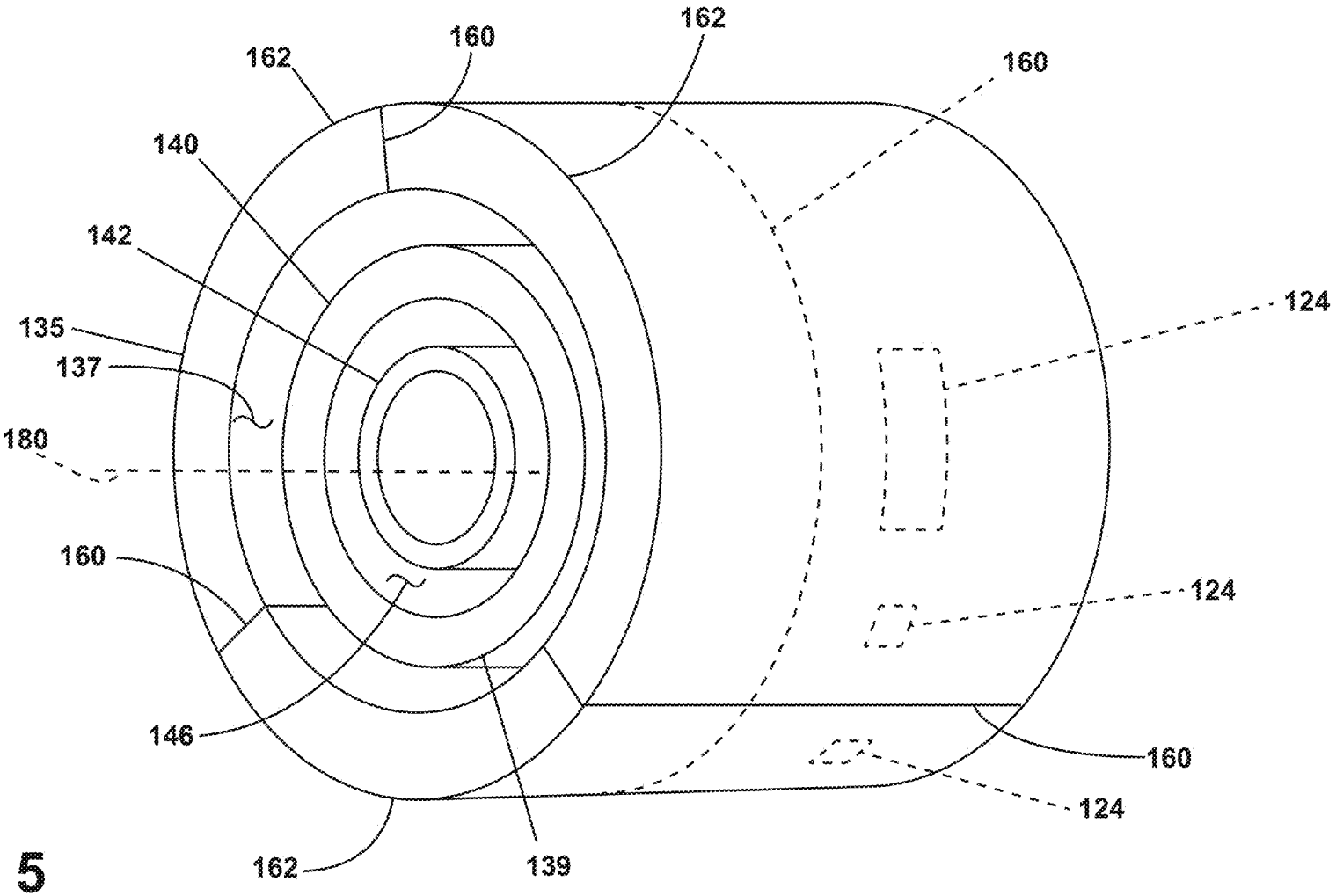
FIG. 5 is schematic perspective view of the combustion section of FIG. 2, further illustrating a set of casing splits.

FIG. 5 is schematic perspective view of the combustion section 100 of FIG. 2. The casing 135 can include a set of casing splits 160 defining a set of casing segments 162. The set of casing splits 160 can extend radially through at least a portion of the casing 135 and axially, circumferentially (illustrated in phantom lines), or a combination thereof along the at least a portion of the casing 135. It will be appreciated that the combustor liner 139, the dome wall 144 (FIG. 3), or a combination thereof can include a set of splits similar to the set of casing splits 160.

The fuel port 124 is provided along any suitable portion of the casing 135 and has any suitable shape or size. As a non-limiting example, each casing segment 162 can include one or more fuel ports 124. As a non-limiting example, each casing segment 162 can include a single fuel port 124. A single gaseous fuel supply 122 (FIG. 3) extends through each fuel port 124. Each fuel port 124 can be formed as a polygonal cutout provided along the outer combustor liner 140 taking any suitable form such as, but not limited to, circular, rectangular, triangular, or the like. Each fuel port 124 can be identical to or different from other fuel ports 124.

Figure 6:
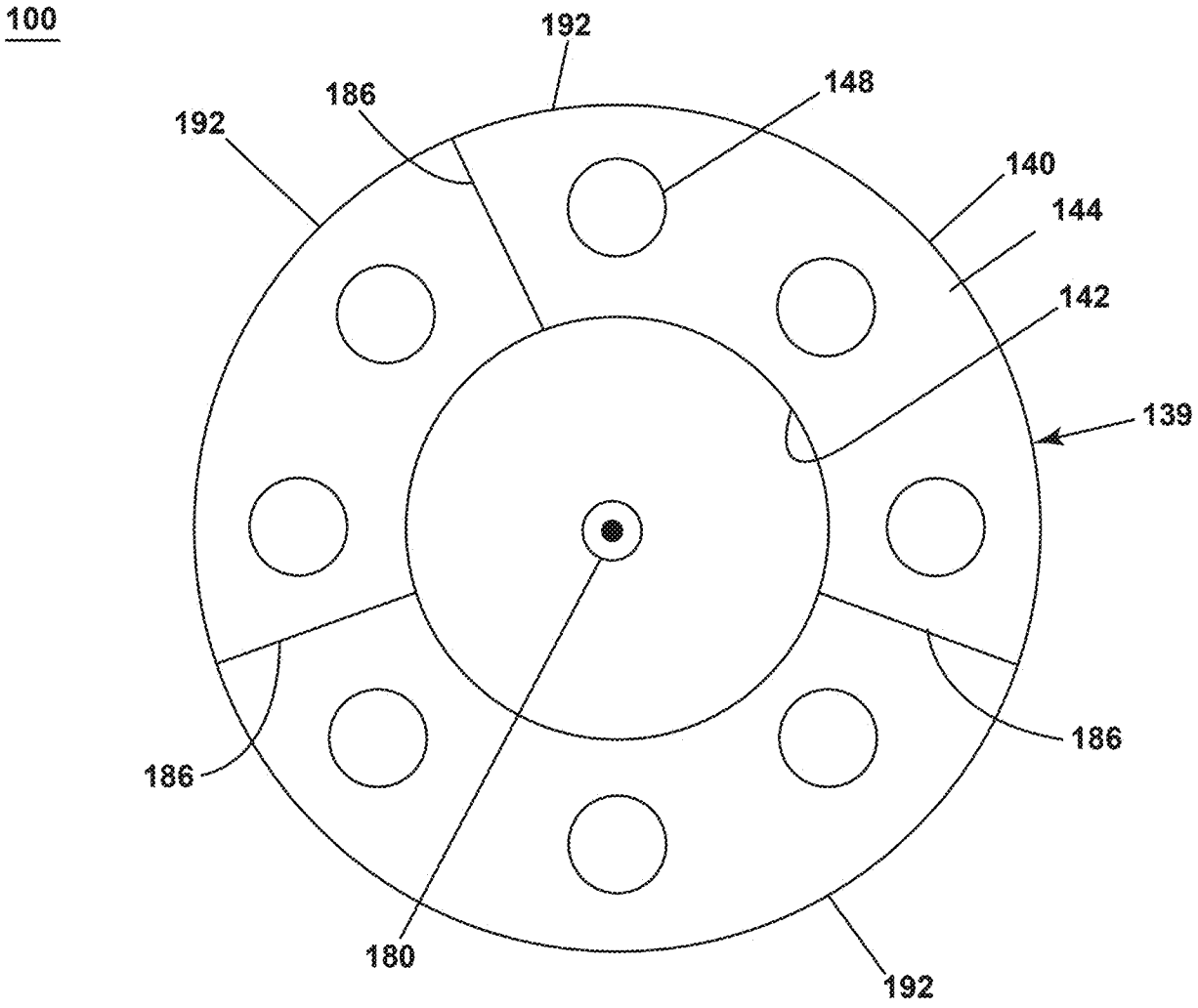
FIG. 6 is a schematic view of the combustion section of FIG. 2, further illustrating a set of dome wall splits provided along the dome wall.

FIG. 6 is a schematic view of the combustion section 100 of FIG. 2. The dome wall 144 can include a set of dome wall splits 186 that split the dome wall 144 into a set of dome wall segments 192. The set of dome wall splits 186 can extend radially or circumferentially about the combustor centerline 180. Each segment of the set of dome wall segments 192 can include one or more fuel nozzles 148. Each segment of the set of dome wall segments 192 can include the same number of or differing numbers of fuel nozzles 148. Each fuel nozzle 148 can be provided entirely within a specific one segment of the set of dome wall segments 192. Alternatively, at least one fuel nozzle of the set of fuel nozzles 148 can be provided along a respective split of the set of dome wall splits 186 such that the at least one fuel nozzle 148 extends between two or more dome wall segments 192.

With reference to FIGS. 5 and 6, each casing segment of the set of casing segments 162, and each dome wall segment of the set of dome wall segments 192 is coupled to one another through any suitable coupling method such as, but not limited to, adhesion, welding, fastening, or the like. It will be appreciated that adjacent casing segments 162 and adjacent dome wall segments 192 are fluidly sealed to one another such that a flow of fluid cannot pass directly through the set of casing splits 160 and set of dome wall splits 186, respectively.

The use of the set of casing splits 160 and the set of dome wall splits 186 is for manufacturing purposes. As discussed herein, at least the fuel nozzle 148 and the gaseous fuel supply channel 122 are formed as a unitary body. The splitting of the casing 135, the dome wall 144, or the combination thereof into respective segments allows for easy installation of the unitary body defining at least the fuel nozzle 148 and the gaseous fuel supply channel 122.

Figure 7:
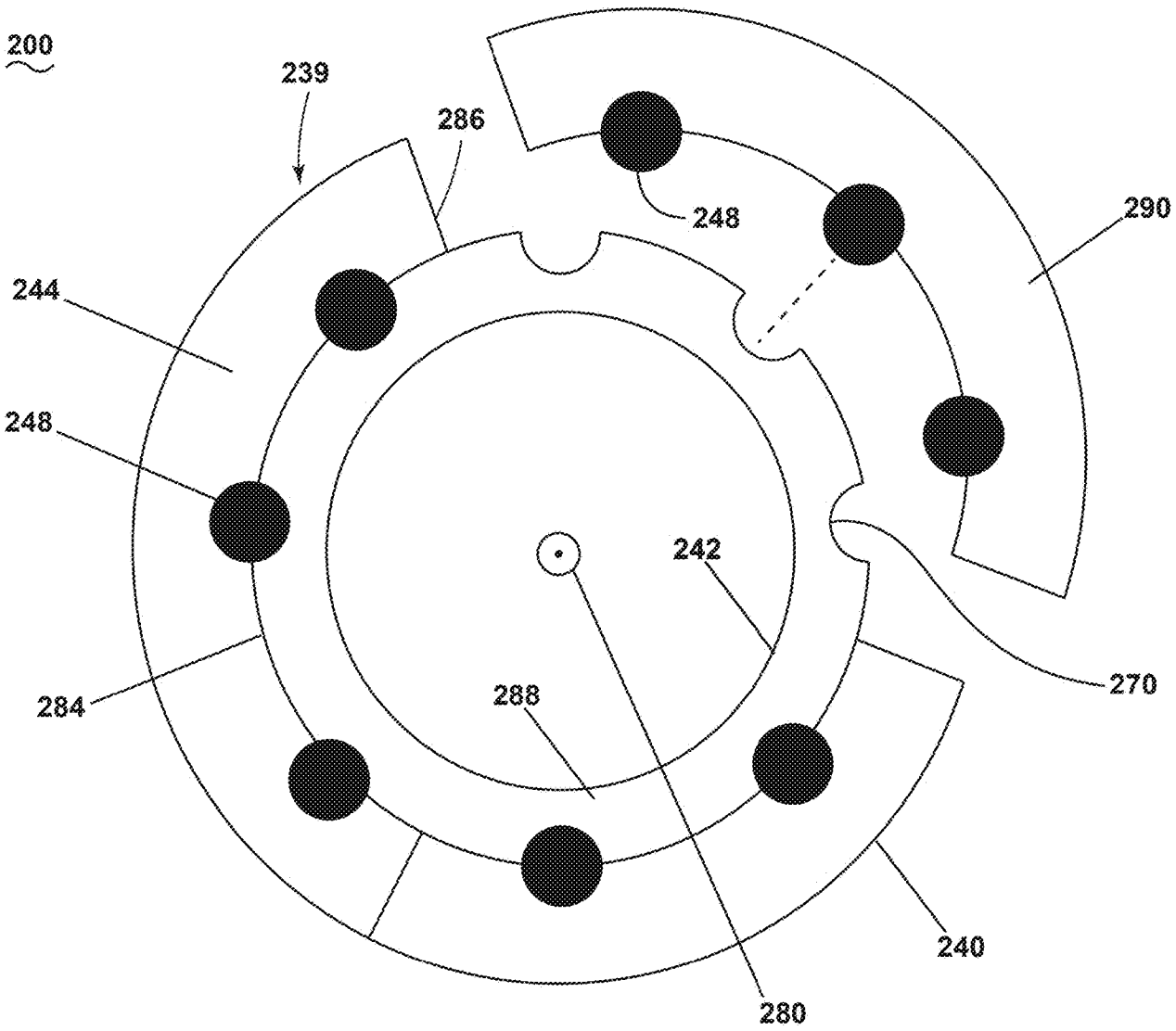
FIG. 7 is schematic perspective view of a combustion section suitable for use within the turbine engine of FIG. 1, further illustrating a circumferential dome wall split.

FIG. 7 is schematic perspective view of a combustion section 200 suitable for use within the turbine engine 10 of FIG. 1. The combustion section 200 is similar to the combustion section 100; therefore, like parts will be identified with like numerals increased to the 200 series with it being understood that the description of the combustion section 100 applies to the combustion section 200 unless noted otherwise.

The combustion section 200 includes a combustor liner 239. The combustor liner 239 includes an outer combustor liner 240 and an inner combustor liner 242. A dome wall 244 interconnects the outer combustor liner 240 and the inner combustor liner 242. The combustion section 200 includes a set of fuel nozzles 248 annularly arranged along the dome wall 244 about a combustor centerline 280.

The combustor liner 239, like the combustor liner 139 (FIG. 3), can be split along a set of dome wall splits (e.g., the set of dome wall splits 186 of FIG. 5) to define a set of dome wall segments (e.g., the set of dome wall segments 192 of FIG. 5). The difference, however, is that the set of dome wall splits include a circumferential dome wall split 284 and a set of radial dome wall splits 286. The circumferential dome wall split 284 extends circumferentially about the combustor centerline 280. The set of radial dome wall splits 286 extend radially outward from, inward from, or a combination thereof, the circumferential dome wall split 284.

The circumferential dome wall split 284 splits the dome wall 244 into an inner dome wall segment 288 and an outer dome wall segment 290. The set of radial dome wall splits 286 split at least one of the inner dome wall segment 288, the outer dome wall segment 290, or a combination thereof into circumferentially spaced segments. As a non-limiting example, the set of radial dome wall splits 286 can be provided in only the outer dome wall segment 290 such that the outer dome wall segment 290 includes a plurality of circumferentially spaced segments, while the inner dome wall segment 288 includes a single, continuous inner dome wall segment 288.

The set of fuel nozzles 248 can be provided along the circumferential dome wall split 284. As a non-limiting example, at least one of the inner dome wall segment 288, the outer dome wall segment 290, or a combination thereof can include a set of fuel nozzle seats 270 adapted to fit the set of fuel nozzles 248. The set of fuel nozzles 248 can be integrally or non-integrally formed with at least one of either the inner dome wall segment 288, the outer dome wall segment 290, or a combination thereof. Utilizing both the circumferential dome wall split 284 and the set of radial dome wall splits 286 allows for a decreased burden of assembly when compared to the combustion section 100.

Figure 8:
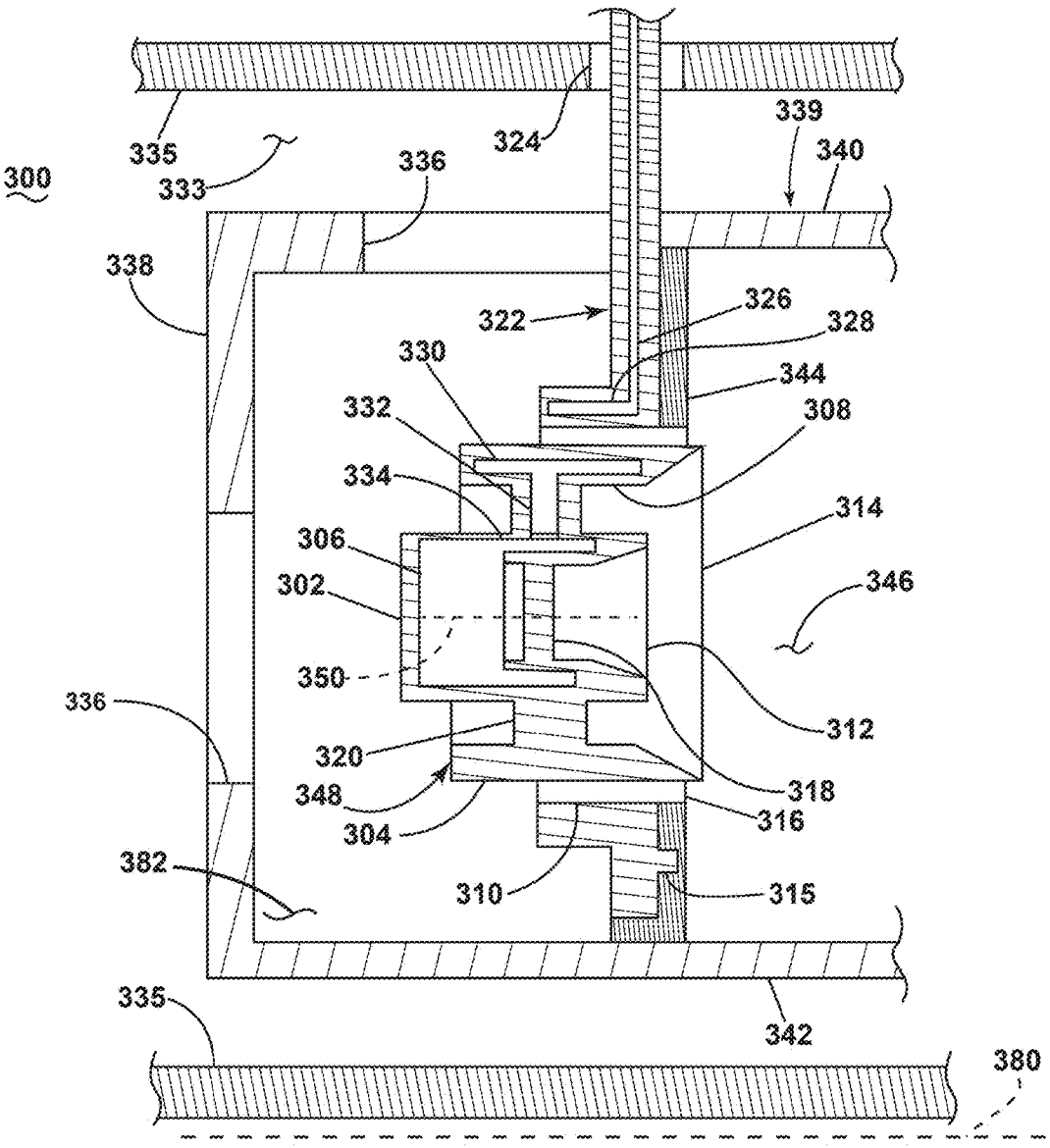
FIG. 8 is a schematic of a side cross-sectional view of an exemplary combustion section suitable for use within the turbine engine of FIG. 1, further illustrating a casing, a dome wall, a combustor liner, and a gaseous fuel supply, the gaseous fuel supply being separate from the dome wall.

FIG. 8 is schematic side cross-sectional view of a combustion section 300 suitable for use within the turbine engine 10 of FIG. 1. The combustion section 300 is similar to the combustion section 100, 200; therefore, like parts will be identified with like numerals increased to the 300 series with it being understood that the description of the combustion section 100, 200 applies to the combustion section 300 unless noted otherwise.

The combustion section 300 includes a casing 335 and a combustor liner 339. The combustor liner 339 includes an inner combustor liner 342, an outer combustor liner 340, and a cowl 338. The combustor liner 339 is at least partially encased by the casing 335. A compressed air passageway 333 is at least partially formed between the casing 335 and the combustor liner 339. A dome wall 344 interconnects the outer combustor liner 340 and the inner combustor liner 342. The dome wall 344 can be non-integrally formed with the combustor liner 339. The dome wall 344 and the combustor liner 339 at least partially define a combustion chamber 346. The cowl 338 includes a compressed air opening 336. The cowl 338 and the dome wall 344 at least partially define a cavity 382. The combustion section 300 includes a set of fuel nozzles 348 annularly arranged along the dome wall 344 about a combustor centerline 380. The set of fuel nozzles 348 terminate axially within the cavity 382.

Each fuel nozzle of the set of fuel nozzles 348 includes a first body 302 and a second body 304. The first body 302 includes a centerline axis 350 and defines a gaseous fuel channel 306. The gaseous fuel channel 306 exhausts into the combustion chamber 346 at a gaseous fuel outlet 312. The second body 304 defines a compressed air channel 308. The compressed air channel 308 exhausts into the combustion chamber 346 at a compressed air outlet 314. The fuel nozzle 348 further includes a set of flame shaping holes 310 at least partially defined by the dome wall 344. The set of flame shaping holes 310 that exhausts into the combustion chamber 346 at a flame shaping outlet 316. A gaseous fuel swirler 318 is provided within the gaseous fuel channel 306. An air swirler 320 is provided within the compressed air channel 308 and interconnects the first body 302 and the second body 304.

A gaseous fuel supply channel 322 extends through a fuel port 324 provided along the casing 335. The gaseous fuel supply channel 322 includes a dome wall inlet segment 326, a first circumferential gaseous fuel manifold 328, a second circumferential gaseous fuel manifold 330, a swirler segment 332, and a third circumferential gaseous fuel manifold 334. At least a portion of the dome wall inlet segment 326 is formed with the dome wall 344.

The combustion section 300 is similar to the combustion section 100, 200 of FIGS. 1-7 in that the fuel nozzle 348 is integrally formed with the gaseous fuel supply channel 322. However, the fuel nozzle 348 and the gaseous fuel supply channel 322 are non-integrally formed with at least the dome wall 344. The dome wall inlet segment 326 extends along the dome wall 344 but not through the dome wall 344, like the dome wall inlet segment 126 (FIG. 4). Further, the cowl 338 can include a compressed air opening 336 that at least partially defines the fuel port 324. In other words, the gaseous fuel supply channel 322 can extend through a respective compressed air opening 336.

A lock 315 defines a coupling of the fuel nozzle 348 and the dome wall 344. The lock 315 is any suitable component, structure or assembly that retains the fuel nozzle 348 to the dome wall 344. As a non-limiting example, the lock 315 can be formed by a projection extending from the fuel nozzle 348 that interfaces with or otherwise fits within a groove or cutout provided along the dome wall 344, or vice-versa. The lock 315 can extend circumferentially along the dome wall 344, the fuel nozzle 348, or a combination thereof for an entirety of or less than an entirety of a circumferential extent of the centerline axis 350. The lock 315 can be provided along any suitable portion of the fuel nozzle 348 confronting portion of the dome wall 344. There can be any number of one or more locks 315 formed between the dome wall 344 and the fuel nozzle 348.

Forming the fuel nozzle 348 and the gaseous fuel supply channel 322 separate from the dome wall 144 increases the lifespan of the fuel nozzle 348 and the gaseous fuel supply channel 322. As discussed herein, the dome wall 344 experiences thermal stress during operation of the combustion section 300. During maintenance, the dome wall 344 can be replaced if it has degraded too far. If the fuel nozzle 348, the gaseous fuel supply channel 322 and the dome wall 344 were integrally formed, however this would mean that the fuel nozzle 348, the gaseous fuel supply channel 322 and the dome wall 344 would all need to be replaced. The replacement would need to be done even though certain portions, such as the fuel nozzle 348 and the gaseous fuel supply channel 322, may not require replacement at that point in time. As the gaseous fuel supply channel 322 is abutting the dome wall 344, the flow of gaseous fuel within the gaseous fuel supply channel 322 is still used as a cooling fluid to reduce the temperature of the dome wall 344.

Benefits of the present disclosure include a combustor suitable for use with a gaseous H2 fuel. As outlined previously, gaseous H2 fuels have a higher flame temperature, likelihood for flashback and likelihood for auto-ignition than traditional fuels (e.g., fuels not containing hydrogen). That is, gaseous H2 fuels have a wider flammable range and a faster burning velocity than traditional fuels such petroleum-based fuels, or petroleum and synthetic fuel blends. These high burn temperatures of gaseous H2 fuels mean that additional insulation is needed between the ignited gaseous H2 fuel and surrounding components of the turbine engine or gas turbine engine (e.g., the dome wall, the inner/outer liner, and other parts of the turbine engine). Further, additional structure to mitigate flashback and stop undesired auto-ignition is needed; problems not faced by combustors utilizing traditional fuels. The combustor, as described herein, includes a fuel nozzle that provides a layer of insulation between the flame and portions of the combustion section, keeps the mixed flow of fuel below the auto-ignition temperature, and prevents flashback from accruing within the fuel nozzle. The fuel nozzle further aides in flame shaping which helps with ensuring liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. That is, the fuel nozzle, as described herein, ensure an even, uniform, or otherwise desired flame propagation within the combustor.

Benefits associated with using hydrogen-containing fuel over traditional fuels include an eco-friendlier engine as the hydrogen-containing fuel, when combusted, generates less carbon pollutants than a combustor using traditional fuels. For example, a combustor including 100% hydrogen-containing fuel (e.g., the fuel is 100% $H_2$) would have zero carbon pollutants. The combustor, as described herein, can be used in instances where 100% hydrogen-containing fuel is used.

Benefits of the present disclosure include a less complex combustion section when compared to a conventional combustion section. For example, the conventional combustion section includes a fuel nozzle having a fuel supply channel that extends through the combustor liner and to the fuel supply. Each fuel nozzle in the conventional combustion section can include a respective fuel supply channel that is fluidly coupled to the fuel supply. The combustion section as described herein, however, includes the gaseous fuel channel that fluidly couples one or more fuel nozzles to the fuel supply without having to extend the gaseous fuel supply channel of the fuel nozzles through the combustor liner, this, in turn, reduces the complexity of the combustion section by eliminating the need for each fuel nozzle to include a fuel supply channel that extends through the combustor liner and to the fuel supply as the conventional combustion section includes.

To the extent not already described, the different features and structures of the various embodiments can be used in combination, or in substitution with each other as desired. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A turbine engine comprising a compression section, a combustion section, and a turbine section in serial flow arrangement, the combustion section having a combustor centerline, the combustion section comprising a combustor liner having an inner combustor liner and an outer combustor liner, and a dome wall, the combustor liner and the dome wall collectively defining a combustion chamber, the dome wall having a fuel nozzle opening, a casing at least partially enclosing the combustor liner, the casing having at least one opening defining a fuel port extending therethrough, a fuel nozzle provided within the fuel nozzle opening, the fuel nozzle having a first body defining a centerline axis and a gaseous fuel channel, the gaseous fuel channel including a gaseous fuel outlet exhausting into the combustion chamber, and a second body, radially spaced from the first body to define a compressed air channel therebetween, the compressed air channel including a compressed air outlet exhausting into the combustion chamber, and a gaseous fuel supply channel extending through the fuel port and to the gaseous fuel channel, with at least a portion of the gaseous fuel supply channel being formed with the dome wall.

The turbine engine of any preceding clause, wherein the gaseous fuel supply channel and the fuel nozzle are integrally formed as a unitary body.

The turbine engine of any preceding clause, wherein the fuel nozzle and the gaseous fuel supply channel are integrally formed with the dome wall.

The turbine engine of any preceding clause, wherein the fuel nozzle further comprises an air swirler provided within the compressed air channel and interconnecting the first body and the second body.

The turbine engine of any preceding clause, wherein the gaseous fuel supply channel includes a swirler segment extending through an interior of the air swirler.

The turbine engine of any preceding clause, wherein the gaseous fuel supply channel includes a dome wall inlet segment extending along or integrally formed within a respective portion of the dome wall.

The turbine engine of any preceding clause, wherein the combustion section comprises a cowl defining a cavity provided on an opposing side of the dome wall from the combustion chamber, with the fuel nozzle terminating axially within the cavity.

The turbine engine of any preceding clause, wherein the combustion section further comprises a set of flame shaping holes provided between the second body and a respective portion of the dome wall, each flame shaping hole of the set of flame shaping holes exhausting into the combustion chamber at a flame shaping outlet.

The turbine engine of any preceding clause, wherein the set of flame shaping holes includes a plurality of flame shaping holes circumferentially spaced about the centerline axis.

The turbine engine of any preceding clause, wherein the gaseous fuel supply channel comprises a first circumferential gaseous fuel manifold, a second circumferential gaseous fuel manifold formed within the second body, and a third circumferential gaseous fuel manifold formed within the first body, the third circumferential gaseous fuel manifold provided radially inward from the second circumferential gaseous fuel manifold, the second circumferential gaseous fuel manifold provided radially inward from the first circumferential gaseous fuel manifold.

The turbine engine of any preceding clause, wherein the casing includes a set of casing splits defining two or more casing segments.

The turbine engine of any preceding clause, wherein the two or more casing segments are axially or circumferentially spaced, with respect to the combustor centerline.

The turbine engine of any preceding clause, wherein the casing includes a plurality of openings defining a plurality of fuel ports, with each casing segment of the two or more casing segments including at least one fuel port of the plurality of fuel ports.

The turbine engine of any preceding clause, wherein the dome wall includes a set of dome wall splits defining two or more dome wall segments.

The turbine engine of any preceding clause, wherein the two or more dome wall segments are at least one of radially spaced, circumferentially spaced, or a combination thereof from one another.

The turbine engine of any preceding clause, wherein the set of dome wall splits include a circumferential dome wall split splitting the dome wall into at least one outer dome wall segment and at least one inner dome wall segment.

The turbine engine of any preceding clause, wherein at least one of the inner dome wall segment, the outer dome wall segment, or a combination thereof includes a fuel nozzle seat provided along the circumferential dome wall split and adapted to accept the fuel nozzle.

The turbine engine of any preceding clause, wherein the fuel nozzle is included within a plurality of fuel nozzles annularly arranged along the dome wall, with two or more fuel nozzles being fluidly coupled to a single gaseous fuel supply channel A method of operating the combustion section of any preceding clause, the method comprising supplying a flow of gaseous hydrogen fuel to the gaseous supply fuel channel through the gaseous fuel channel, and supplying a flow of compressed air to the compressed air channel.

The turbine engine of any preceding clause, wherein the dome wall and the fuel nozzle are non-integrally formed.

The turbine engine of any preceding clause, wherein the combustion section further comprises a lock defining a coupling of the dome wall and the fuel nozzle.

The turbine engine of any preceding clause, wherein the lock includes a projection extending from the fuel nozzle and interfacing with a groove provided along the dome wall.

A combustion section having a combustor centerline, the combustion section comprising a combustor liner having an inner combustor liner and an outer combustor liner, and a dome wall, the combustor liner and the dome wall collectively defining a combustion chamber, the dome wall having a fuel nozzle opening, a casing at least partially enclosing the combustor liner, the casing having at least one opening defining a fuel port extending therethrough, a fuel nozzle provided within the fuel nozzle opening, the fuel nozzle having a first body defining a centerline axis and a gaseous fuel channel, the gaseous fuel channel including a gaseous fuel outlet exhausting into the combustion chamber, and a second body, radially spaced from the first body to define a compressed air channel therebetween, the compressed air channel including a compressed air outlet exhausting into the combustion chamber, and a gaseous fuel supply channel extending through the fuel port and to the gaseous fuel channel, with at least a portion of the gaseous fuel supply channel being formed with the dome wall.

The combustion section of any preceding clause, wherein the gaseous fuel supply channel and the fuel nozzle are integrally formed as a unitary body.

The combustion section of any preceding clause, wherein the fuel nozzle and the gaseous fuel supply channel are integrally formed with the dome wall.

The combustion section of any preceding clause, wherein the fuel nozzle further comprises an air swirler provided within the compressed air channel and interconnecting the first body and the second body.

The combustion section of any preceding clause, wherein the gaseous fuel supply channel includes a swirler segment extending through an interior of the air swirler.

The combustion section of any preceding clause, wherein the gaseous fuel supply channel includes a dome wall inlet segment extending along or integrally formed within a respective portion of the dome wall.

The combustion section of any preceding clause, further comprising a cowl defining a cavity provided on an opposing side of the dome wall from the combustion chamber, with the fuel nozzle terminating axially within the cavity.

The combustion section of any preceding clause, further comprising a set of flame shaping holes provided between the second body and a respective portion of the dome wall, each flame shaping hole of the set of flame shaping holes exhausting into the combustion chamber at a flame shaping outlet.

The combustion section of any preceding clause, wherein the set of flame shaping holes includes a plurality of flame shaping holes circumferentially spaced about the centerline axis.

The combustion section of any preceding clause, wherein the gaseous fuel supply channel comprises a first circumferential gaseous fuel manifold, a second circumferential gaseous fuel manifold formed within the second body, and a third circumferential gaseous fuel manifold formed within the first body, the third circumferential gaseous fuel manifold provided radially inward from the second circumferential gaseous fuel manifold, the second circumferential gaseous fuel manifold provided radially inward from the first circumferential gaseous fuel manifold.

The combustion section of any preceding clause, wherein the casing includes a set of casing splits defining two or more casing segments.

The combustion section of any preceding clause, wherein the two or more casing segments are axially or circumferentially spaced, with respect to the combustor centerline.

The combustion section of any preceding clause, wherein the casing includes a plurality of openings defining a plurality of fuel ports, with each casing segment of the two or more casing segments including at least one fuel port of the plurality of fuel ports.

The combustion section of any preceding clause, wherein the dome wall includes a set of dome wall splits defining two or more dome wall segments.

The combustion section of any preceding clause, wherein the two or more dome wall segments are at least one of radially spaced, circumferentially spaced, or a combination thereof from one another.

The combustion section of any preceding clause, wherein the set of dome wall splits include a circumferential dome wall split splitting the dome wall into at least one outer dome wall segment and at least one inner dome wall segment.

The combustion section of any preceding clause, wherein at least one of the inner dome wall segment, the outer dome wall segment, or a combination thereof includes a fuel nozzle seat provided along the circumferential dome wall split and adapted to accept the fuel nozzle.

The combustion section of any preceding clause, wherein the fuel nozzle is included within a plurality of fuel nozzles annularly arranged along the dome wall, with two or more fuel nozzles being fluidly coupled to a single gaseous fuel supply channel A method of operating the combustion section of any preceding clause, the method comprising supplying a flow of gaseous hydrogen fuel to the gaseous supply fuel channel through the gaseous fuel channel, and supplying a flow of compressed air to the compressed air channel.

The combustion section of any preceding clause, wherein the dome wall and the fuel nozzle are non-integrally formed.

The combustion section of any preceding clause, further comprising a lock defining a coupling of the dome wall and the fuel nozzle.

The combustion section of any preceding clause, wherein the lock includes a projection extending from the fuel nozzle and interfacing with a groove provided along the dome wall.

What is claimed is:

1. A turbine engine comprising:

a compression section, a combustion section, and a turbine section in serial flow arrangement, the combustion section having a combustor centerline, the combustion section comprising:

a combustor liner having an inner combustor liner and an outer combustor liner, and a dome wall extending between the outer combustor liner and the inner combustor liner, the combustor liner and the dome wall collectively defining a combustion chamber, the dome wall having a fuel nozzle opening;

a casing at least partially enclosing the combustor liner, the casing having at least one opening defining a fuel port extending therethrough;

a fuel nozzle provided within the fuel nozzle opening, the fuel nozzle having:

a first body defining a centerline axis and a gaseous fuel channel, the gaseous fuel channel including a gaseous fuel outlet exhausting into the combustion chamber; and a second body, radially spaced from the first body to define a compressed air channel therebetween, the compressed air channel including a compressed air outlet exhausting into the combustion chamber; and a gaseous fuel supply channel extending through the fuel port and to the gaseous fuel channel, the gaseous fuel supply channel extending radially within the dome wall towards the combustor centerline;

wherein during operation of the combustion section, a flow of gaseous fuel emitted from the fuel nozzle is ignited to generate a flame within the combustion chamber, and the gaseous fuel supply channel is formed within a respective portion of the dome wall exposed to the flame.

2. The turbine engine of claim 1, wherein the gaseous fuel supply channel and the fuel nozzle are integrally formed as a unitary body.

3. The turbine engine of claim 1, wherein the fuel nozzle further comprises an air swirler provided within the compressed air channel and interconnecting the first body and the second body.

4. The turbine engine of claim 3, wherein the gaseous fuel supply channel includes a swirler segment extending through an interior of the air swirler.

5. The turbine engine of claim 1, wherein the gaseous fuel supply channel includes a dome wall inlet segment extending along or integrally formed within a respective portion of the dome wall.

6. The turbine engine of claim 1, wherein the combustion section comprises a cowl defining a cavity provided on an opposing side of the dome wall from the combustion chamber, with the fuel nozzle terminating axially within the cavity.

7. The turbine engine of claim 1, wherein the combustion section further comprises a set of flame shaping holes provided between the second body and a respective portion of the dome wall, each flame shaping hole of the set of flame shaping holes exhausting into the combustion chamber at a flame shaping outlet.

8. The turbine engine of claim 7, wherein the set of flame shaping holes includes a plurality of flame shaping holes circumferentially spaced about the centerline axis.

9. A turbine engine comprising:

a compression section, a combustion section, and a turbine section in serial flow arrangement, the combustion section having a combustor centerline, the combustion section comprising:

a combustor liner having an inner combustor liner and an outer combustor liner, and a dome wall, the combustor liner and the dome wall collectively defining a combustion chamber, the dome wall having a fuel nozzle opening;

a casing at least partially enclosing the combustor liner, the casing having at least one opening defining a fuel port extending therethrough;

a fuel nozzle provided within the fuel nozzle opening, the fuel nozzle having:

a first body defining a centerline axis and a gaseous fuel channel, the gaseous fuel channel including a gaseous fuel outlet exhausting into the combustion chamber; and a second body, radially spaced from the first body to define a compressed air channel therebetween, the compressed air channel including a compressed air outlet exhausting into the combustion chamber; and a gaseous fuel supply channel extending through the fuel port and to the gaseous fuel channel, with at least a portion of the gaseous fuel supply channel being formed with the dome wall, the gaseous fuel supply channel comprising:

a first circumferential gaseous fuel manifold;

a second circumferential gaseous fuel manifold formed within the second body; and a third circumferential gaseous fuel manifold formed within the first body, the third circumferential gaseous fuel manifold provided radially inward from the second circumferential gaseous fuel manifold, the second circumferential gaseous fuel manifold provided radially inward from the first circumferential gaseous fuel manifold.

10. The turbine engine of claim 1, wherein the casing includes a set of casing splits defining two or more casing segments.

11. The turbine engine of claim 10, wherein the two or more casing segments are axially or circumferentially spaced, with respect to the combustor centerline.

12. The turbine engine of claim 10, wherein the casing includes a plurality of openings defining a plurality of fuel ports.

13. The turbine engine of claim 12, wherein with each casing segment of the two or more casing segments including at least one fuel port of the plurality of fuel ports.

14. The turbine engine of claim 1, wherein the dome wall includes a set of dome wall splits defining two or more dome wall segments.

15. The turbine engine of claim 14, wherein the two or more dome wall segments are at least one of radially spaced, circumferentially spaced, or a combination thereof from one another.

16. The turbine engine of claim 14, wherein the set of dome wall splits include a circumferential dome wall split splitting the dome wall into at least one outer dome wall segment and at least one inner dome wall segment.

17. The turbine engine of claim 16, wherein at least one of the inner dome wall segment, the outer dome wall segment, or a combination thereof includes a fuel nozzle seat provided along the circumferential dome wall split and adapted to accept the fuel nozzle.

18. The turbine engine of claim 1, wherein the fuel nozzle is included within a plurality of fuel nozzles annularly arranged along the dome wall, with two or more fuel nozzles being fluidly coupled to a single gaseous fuel supply channel.

19. A method of operating the combustion section of claim 1, the method comprising:

supplying a flow of gaseous hydrogen fuel to the gaseous supply fuel channel through the gaseous fuel channel; and supplying a flow of compressed air to the compressed air channel.

* * * * *